US005996446A

United States Patent [19]

Lee

[11] Patent Number: 5,996,446

[45] Date of Patent: Dec. 7, 1999

[54] SIZE ADJUSTABLE WRENCH SOCKET

[76] Inventor: Han Young Lee, 1722 Apollo Road, #2003, Garland, Tex. 75044

[21] Appl. No.: 09/031,529

[22] Filed: Feb. 27, 1998

Related U.S. Application Data

[63] Continuation-in-part of application No. 08/771,342, Dec. 16, 1996, abandoned.

[51] Int. Cl.[6] ..... B25B 13/18

[52] U.S. Cl. ..... 81/128; 279/114

[58] Field of Search ..... 81/128, 129, 129.5, 81/53.2; 279/66, 71, 110, 114

[56] References Cited

U.S. PATENT DOCUMENTS

| | | | |
|---|---|---|---|
| 915,443 | 3/1909 | Jones | 81/128 X |
| 2,580,247 | 12/1951 | Secondi et al. . | |
| 2,884,826 | 5/1959 | Bruhn . | |
| 3,724,299 | 4/1973 | Nelson . | |
| 3,731,722 | 5/1973 | Carr . | |
| 3,908,488 | 9/1975 | Andersen . | |
| 4,112,792 | 9/1978 | Guimarin . | |
| 4,277,991 | 7/1981 | Stubenrauch . | |
| 4,663,998 | 5/1987 | Parsons et al. . | |
| 4,663,999 | 5/1987 | Colvin . | |
| 4,898,052 | 2/1990 | Kang . | |
| 5,819,607 | 10/1998 | Carnesi | 81/128 |

*Primary Examiner*—D. S. Meislin
*Attorney, Agent, or Firm*—Mark W. Handley

[57] ABSTRACT

A size adjustable wrench socket is disclosed which has a plurality of jaws which are slidably engaged within a jaw guide for moving radially inward and outward relative to the jaw guide for fitting threaded fasteners of various sizes. A controller sleeve is configured for engaging upwardly extending protuberances of the jaws, such that rotation of the controller sleeve in various directions will moved the jaws inward and outward relative to the jaw guide. The jaws further include a plurality of upwardly extending teeth which are formed into planar shoulders of intermediate portions of the jaws. A latch member is provided having a planar surface from which a plurality of teeth downwardly extend for engaging the upwardly extending teeth of the planar shoulders of the intermediate portions of the jaws. The latch member is movable from a latched position to a released position. When disposed in the latched position, the teeth of the latch member engage the upwardly extending teeth of the jaws to latch the jaws in a fixed position relative to the jaw guide. In the released position, the teeth of the latch member are spaced apart from the teeth of the jaws such that the jaws are movable relative to the jaw guide. The teeth of the jaws and the jaw guide are sized to provide indexed positions at which the jaws are spaced apart to correspond with predetermined, standard sizes of drive heads for threaded fasteners.

20 Claims, 3 Drawing Sheets

SIZE ADJUSTABLE WRENCH SOCKET

CROSS REFERENCE TO RELATED APPLICATION

The present application is a continuation in part of application Ser. No. 08/771,342, filed Dec. 16, 1996 and entitled "SIZE ADJUSTABLE WRENCH SOCKET,", now abandoned.

TECHNICAL FIELD OF THE INVENTION

The present invention relates in general to wrench sockets for coupling drivers to threaded fasteners for transferring torque therebetween, and in particular to a size adjustable wrench socket which is adjustable for fitting various sizes of threaded fasteners.

BACKGROUND OF THE INVENTION

Wrench sockets have been utilized for applying torque to nuts and the heads of bolts of threaded fasteners. Often, ratchet-type wrench drivers are utilized as drive members for coupling to the wrench sockets to provide driving torque. Prior art wrench sockets have included both wrench sockets of fixed size and wrench sockets having size-adjustable jaws, which may be adjusted for accommodating fastener heads of various sizes. As used herein, the term fastener head includes either a nut or a bolt head, such as that having an hexagonally shaped profile which defines drive surfaces that may be engaged by a wrench socket for transferring torque from the wrench socket to the threaded fastener. Size adjustable wrench sockets have been used both with wrench drivers which have handles that extend at angles such as ninety degrees to an axis of rotation of the wrench sockets, and with in-line drivers in which the handles extend in-line with the axis of rotation of the wrench sockets, such as nut drivers and the like.

Prior art size adjustable wrench sockets have included size adjustable jaws which are mounted to jaw guide members having guide surfaces upon which portions of the jaws slidably engage. These prior art wrench sockets have also included upwardly extending members which engage within slotted collars which are rotatably mounted above the jaw guide members for rotating to move the jaws radially inward and radially outward until the spacing between the jaws is such that torque may be transferred from the wrench sockets to the threaded fasteners. Bias springs have been utilized to bias the jaws to into radially outward positions relative to the jaw guides. Some prior art size adjustable wrench sockets have been continuously adjustable, over continuous ranges of sizes. Other size adjustable wrench sockets have been provided with indexed settings, which correspond to standard sizes of threaded fastener. However, prior art size adjustable wrench sockets have typically proven unsatisfactory in that they fail to provide wrench sockets of adequate strength for remaining engaged with fastener heads when large amounts of torque are applied to the wrench sockets and the fastener heads.

SUMMARY OF THE INVENTION

The present invention disclosed and claimed herein comprises a size adjustable wrench socket having a plurality of jaws which are slidably engaged within a jaw guide for moving radially inward and radially outward relative to the jaw guide for fitting threaded fasteners of various sizes. The size adjustable wrench socket includes a plurality of jaws having upper, intermediate and lower portions. The lower portions of the jaws have drive surfaces for fitting against the drive surfaces of threaded fasteners for transferring torque to the threaded fasteners. The intermediate portions of the jaws have recesses formed therein which define surfaces for slidably engaging guide surfaces of the jaw guide. The upper portions of the jaws also have surfaces which slidingly engage guide surfaces of the jaw guide. The guide surfaces of the jaw guide transfer torque from the jaw guide to the jaws. The upper portions of the jaws further include protuberances which extend upwardly therefrom. The size adjustable wrench socket also includes a controller sleeve having a lower surface into which arcuate grooves are formed for receiving the upwardly extending protuberances of the jaws, such that rotation of the controller sleeve urges the jaws radially inward and radially outward relative to the jaw guide, depending upon the direction of rotation of the controller sleeve. A mandrel extends downwardly though the jaw guide for rotationally coupling the jaw guide to a drive member of a drive tool for transferring torque therebetween. The jaws further include a plurality of upwardly extending teeth which are formed into planar shoulders of intermediate portions of the jaws.

The size adjustable wrench socket further includes a latch member having a planar surface from which a plurality of teeth downwardly extend for engaging the upwardly extending teeth of the planar shoulders of the intermediate portion of the jaws. The latch member is movable from a latched position, in which the teeth of the latch member of the latch member engage the upwardly extending teeth of the jaws to latch the jaws into a fixed position relative to the jaw guide, to a released position, in which the teeth of the latch member are spaced apart from the teeth of the jaws such that the jaws are movable relative to the jaw guide. An exterior surface of the latch member engages within interior facing surfaces of the jaw guides to prevent relative rotation therebetween. The latch member has an exterior profile which is H-shaped to define two slots for receiving the intermediate portions the jaws. The jaws each have a tab which upwardly extends from a ledge surface of the intermediate portion of the jaws, and which is spaced apart, laterally aside of a main body portion of respective ones of the jaws. The tabs extend upward for engaging within the interior surfaces of opposite facing sides of the legs of the H-shaped exterior profile of the latch member to prevent the jaws from twisting relative to the latch member.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
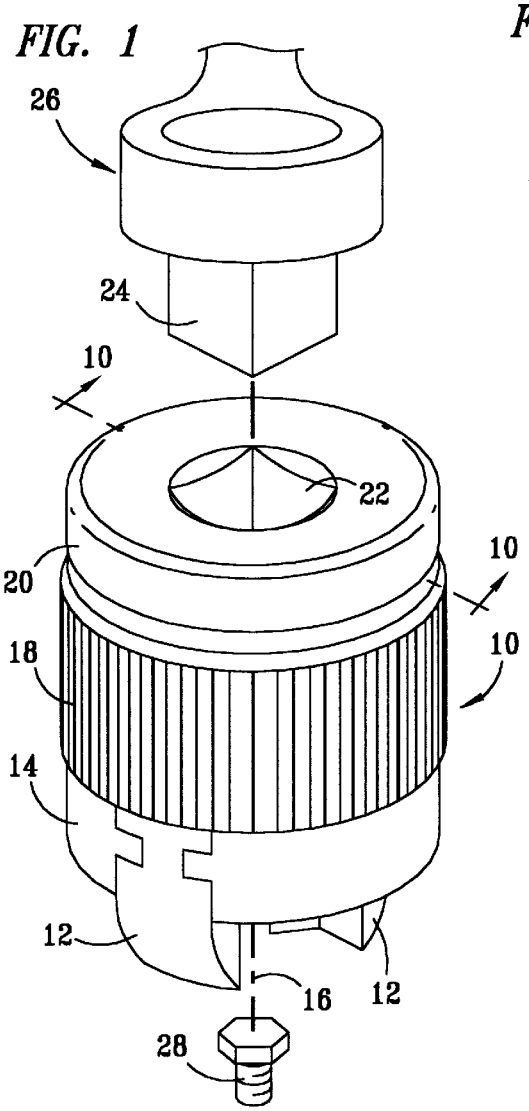
FIG. 1 illustrates a perspective view of size adjustable wrench socket made according to the present invention.

Referring now to FIG. 1, there is illustrated a perspective view of a size adjustable wrench socket 10 made according to the present invention. The socket 10 includes two adjustable jaws 12 which are slidably engaged within a jaw guide 14 for linearly moving inward and outward in radial directions within a jaw guide 14, relative to the jaw guide 14 and a central axis 16. The central axis 16 defines a central axis of rotation about which the size adjustable wrench socket 10 rotated when driven. The size adjustable wrench socket 10 further includes a controller sleeve 18 which is slidably mounted to a mandrel 20. The mandrel 20 has a receiver drive socket 22 in the upper end thereof. The drive socket 22 is sized for receiving a drive pin 24 of a drive 26. The drive 26 is utilized for applying torque to the size adjustable wrench socket 10 for connecting to and rotating a least a portion of a fastening member 28.

Figure 2:
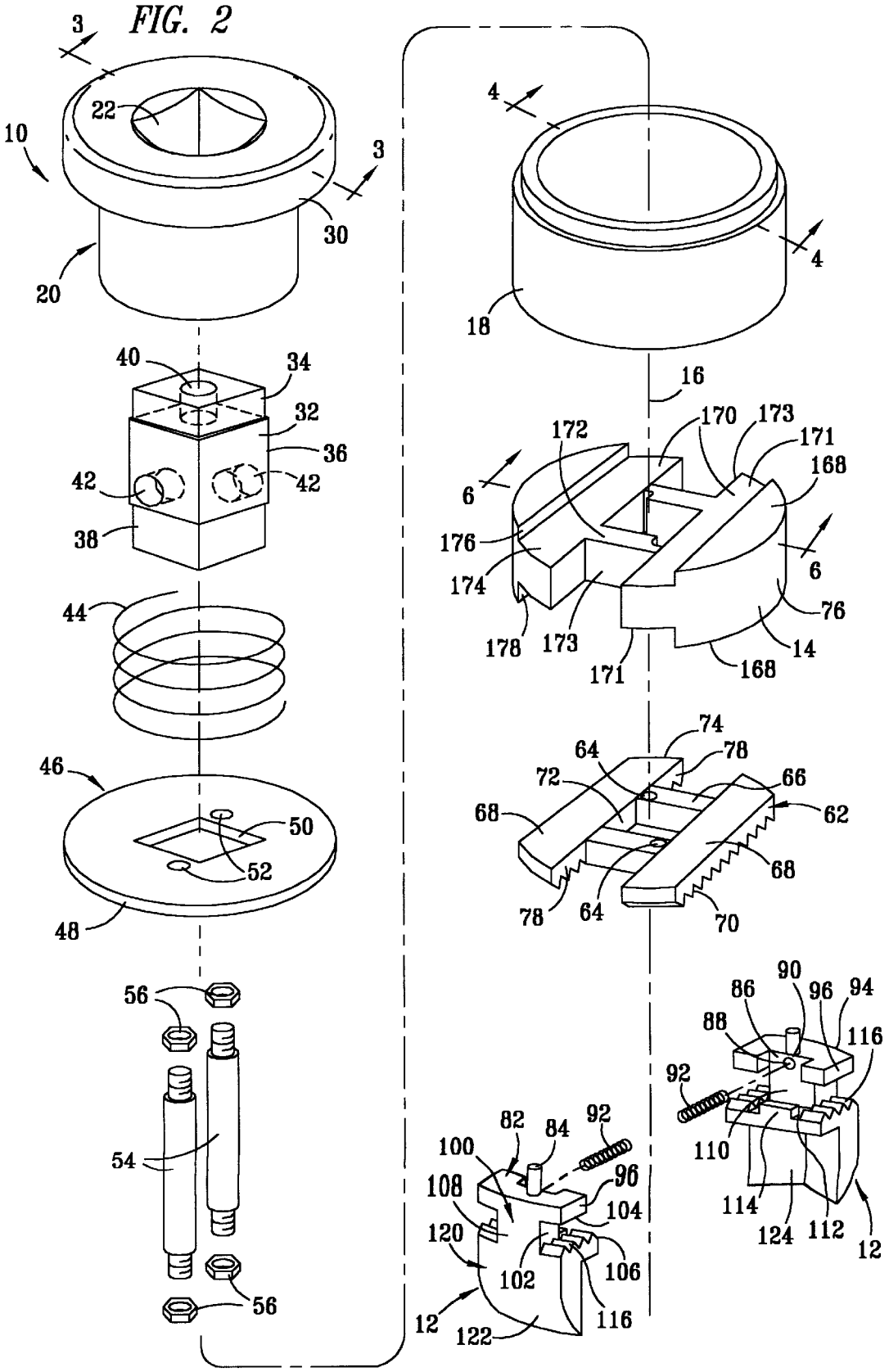
FIG. 2 illustrates an exploded, perspective view of various component of the size adjustable wrench socket of FIG. 1.

Referring now to FIG. 2, there is illustrated an exploded, perspective view the size adjustable wrench socket 10. The mandrel 20 has an upper drive socket portion 30 and a lower coupling portion 32. The upper drive socket portion 30 provides a controller base and has the drive socket 22 formed therein. The lower coupling portion 32 of the mandrel 20 preferably has a square cross section and is formed of solid square bar-stock, and provides a driven shaft for coupling the drive socket portion 30 to the jaws 12 and the jaw guide 14. The lower coupling portion 32 of the mandrel 20 includes an upper section 34, middle section 36 and lower section 38. The upper section 34 and the lower section 38 have a smaller exterior dimension than the middle section 36, such that there is an upper shoulder extending between the upper section 34 and the middle section 38, and a lower shoulder extending between the middle section 36 and the lower section 38. A threaded blind hole 40 extends into the top of the upper section 34. Two blind holes 42 extend on opposite sides of the middle section 36 of the mandrel 20 for receiving the ends of respective radial bias springs 92 to retain respective ones of first ends of each of the radial bias springs 92 in a desired position within the size adjustable wrench socket 10.

The size adjustable wrench socket 10 further includes a bias spring 44. The bias spring 44 is sized for fitting within the controller sleeve 18 and around lower coupling portion 32 of the mandrel 20. An interface member 46 is provided for engaging the lower end of the bias spring 44. Preferably, the interface member 46 is provided by a flat disc having planar upper and lower sides, and a round edge periphery 48. The edge periphery 48 is sized for slidably engaging within the controller sleeve 18. A square hole 50 extends vertically through the interface member 46, and is sized for slidably receiving the middle section 36 of the lower coupling portion 32 of the mandrel 20. Two mounting holes 52 also extend vertically through the interface member 46, and are spaced apart for receiving respective ones of two connecting members 54.

The connecting members 54 are provided by cylindrically shaped rods. The connecting members 54 have threaded ends, with shoulders defined adjacent to the threaded ends. Fastening nuts 56 are provided for securing the threaded upper ends of the connecting members 54 to the interface member 46, with the interface member 46 retained between the shoulders of the connecting member 54 and the fastening nuts 56. The connecting members 54 extend downward from the interface member 46, through the interior of the controller sleeve 18 and the jaw guide 14, to a latch member 62.

The latch member 62 has an exterior profile which, in a horizontal plane, is H-shaped. Vertical holes 64 extend through the latch member 62 for receiving the lower ends of the connecting members 54. Two of the fastening nuts 56 are used to secure the lower threaded ends of the connecting members 54 within the holes 64 of the latch member 62, with the latch member retained between shoulders of the connecting members 54, which are adjacent to the threaded ends thereof and the fastening nuts 56. The latch member 62 further includes two cross-members 66 and two rack members 68. Teeth 70 extend vertically downward from the rack members 68, having ribs and grooves which define crests and roots that extend substantially perpendicular to the direction in which torque forces are applied to operate the size adjustable wrench socket 10 to apply torque to the fastener 28. The teeth 70 are sized such that the jaws 12 will be latched into incremental positions which correspond to a plurality of standard sizes for fastening members such that the jaws 12 will be spaced apart in pre-determined, incremental positions. A square hole 72 extends between the cross-members 66, and may optionally be sized for receiving the lower section 38 of the lower coupling portion 32 of the mandrel 20. Preferably, the hole 72 is sized for receiving the end of a bolt of a threaded fastener when the end of the bolt protrudes above a nut being loosened from the bolt using the sized adjustable wrench socket 10. The outward edge peripheral surfaces of the rack members 68 have rounded corners 74 for fitting flush with the side surfaces76 of the jaw guide 14 when the latch member 62 is assembled within the jaw guide 14. The rack members 68 are spaced apart to define two slots 78, which extend through opposite sides of the latch member 62 for receiving the jaws 12.

The jaws 12 each have an upper portion 82 from which a protuberance 84 extends vertically upward for engaging within the controller sleeve 18. The inwardly facing sides of the upper portions 82 of the jaws 12 each have a vertically extending open slot 86 to allow passage of respective ones of the connecting members 54 such that the connecting member 54 slidably passes through the open slots 86. Adjacent to each of the open slots 86 are blind holes 88. The blind holes 88 are formed into an interiorly facing flat 90 for receipt of respective ones of second ends of radial biasing springs 92. The radial biasing springs 92 may be provided by standard steel coil springs. The first ends of the radial biasing springs fit into respective ones of the blind holes 42 of the middle section 36 of the lower portion 32 of the mandrel 20. The outward facing peripheral edges of the upper portions 82 of the jaws 12 define outer surfaces 94 and flats 96. The flat surfaces 96 engage within the jaw guide 14.

The jaws 12 further include intermediate portions 100. Recesses 102 are formed into the sides of the intermediate portions 100 and define upper shoulders 104 and lower, upwardly facing shoulders 106. Preferably, the recesses 102 are rectangular in shape when viewed in a side view of the jaws 12. Each of the jaws 12 have an upwardly extending main body portion 108 of the intermediate portion 100 of the jaws 12. The main body portions have inward facing surfaces 110 which are recessed from the edge of ledge surfaces 112. Tabs 114 vertically extend upwards from the ledge surfaces 112, spaced apart from and disposed to the side of the inward facing surfaces 110 of the upwardly extending main body portions 108.

A plurality of teeth 116 are formed to extend upward from the shoulders 106, and engage with the downwardly facing teeth 70 of the latch member 62. The teeth 70 and teeth 116 have alternating ribs and grooves which define corresponding roots and crests of the teeth 116 which engage in the roots and crests of the teeth 70. The teeth 70 and the teeth 116 are also sized to have a pitch dimension such that incremental movement according of the teeth 116 relative to the teeth 70 in a radial direction relative to the central axis 16 corresponds to one-half the distance between standard sizes of the heads of threaded fasteners. Preferably, the roots and the crests of the mating teeth 70 and 116 extend in linear directions, which are substantially perpendicular to the directions at which resultant torque forces are applied to guide surfaces and torque surfaces to turn the size adjustable wrench socket 10 about the central axis16. The teeth 70 of the rack members 68 define a latch surface and teeth 116 of the shoulder 106 define a mating surface which is engaged by the latch surface defined by the teeth 70.

The lower portions 120 of the jaws 12 each have a rounded outward facing surface 122 and two flats 124 which face inwardly. The two flats 124 are sized for fitting flush against adjacent drive surfaces of the heads of threaded fasteners, such as a hexagonally shaped nut for threadingly engaging a threaded bolt. The outward facing rounded surfaces 122 are sized for fitting flush with the exterior of the jaw guide 14 when the jaws 12 are disposed in the positions shown in FIG. 1.

Figure 3:
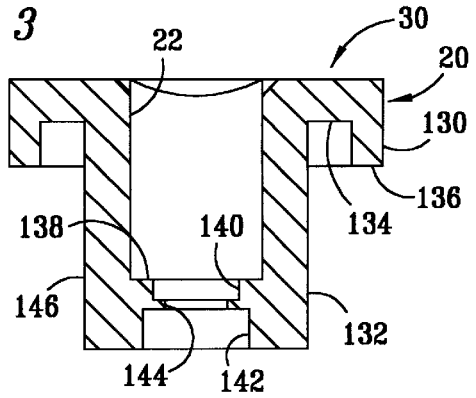
FIG. 3 illustrates a longitudinal section view of a controller base of the size adjustable wrench socket, taken along Section line 3—3 of FIG. 2.

Referring now to FIG. 3, there is illustrated a longitudinal section view of an upper drive socket portion 30 of the mandrel 20 which defines a receiver drive socket 22, taken along section line 3—3 of FIG. 2. The upper end of the mandrel 20 has a large peripheral edge 130 and an elongated, cylindrical body 132. An annular recess 134 extends upwardly into the uppermost end of the mandrel 20, interiorly disposed within the enlarged peripheral edge 130. The recess 134 is sized for receiving a top portion of the controller sleeve 18. A downward facing annular shoulder 136 extends between the recess 134 and the enlarged peripheral edge 130. The drive socket 22 extends into the top of the upper portion 30 of the mandrel 20. An upward facing annular shoulder 138 is defined in the lowermost portion of the socket 22. A recess 140 extends downward into the bottom surface of the socket 22, for receiving a threaded fastener for securing the upper portion 30 of the mandrel 20 to the lower portion 32 of the mandrel 20. The recess 140 may also be sized for receiving a magnet for magnetically securing the size adjustable wrench socket 10 to a driver pin 24. A square recess 142 extends in the lowermost portion of upper drive socket portion 30 for receiving the square upper section 34 of the lower coupling portion 32 of the mandrel 20 such that they are co-rotationally coupled with flats at the square edges of the recess 142 engaging the flats of the square upper section 34 of the lower coupling portion 32 of the mandrel 20. Thus, a drive 26 having a drive member 24 engaging within a socket 22 will be co-rotationally coupled to the lower coupling portion 32 of the mandrel 20 by the flats of the square recess 142 engaging the square peripheral surfaces of the upper section 34 of the lower coupling portion 32 of the mandrel 20. A through hole 144 extends between the recess 140 and the recess 142. The cylindrical outer surface 146 of the cylindrical body 132 provides a bearing surface on which the controller sleeve 18 is rotatably mounted for rotation about the central axis 16 (shown in FIG. 1).

Figure 4:
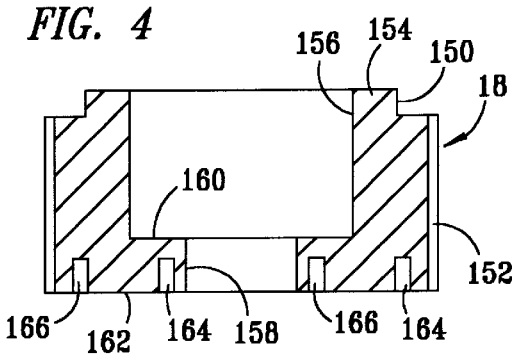
FIG. 4 illustrates a longitudinal section view of a controller member of the size adjustable wrench socket, taken along Section line 4—4 of FIG. 2.

Referring now to FIG. 4, there is illustrated a longitudinal sectional view of the controller sleeve 18, taken along section line 4—4 of FIG. 2. The controller sleeve 18 provides a controller member for selectively moving to selectively control the radial spacing, relative to the central axis of rotation 16, between the jaws 12. The controller sleeve 18 has a cylindrical shape, with an upper periphery 150 and a lower periphery 152. The upper periphery 150 is recessed from the lower periphery 152 by an annular tab 154. The annular tab 154 is sized such that it extends interiorly within the annular recess 134 which extends into the upper drive socket portion 30 of the mandrel 20. A cylindrical bore 156 extends interiorly within the upper portion of the controller 18 for slidably engaging the bearing surface provided by the cylindrical outer surface 146 of the upper drive socket portion 30 of the mandrel 20. The interior bore 156 is also sized for slidably receiving the interface member 46 (shown in FIG. 2). The bore 156 extends downwards and into a lower portion of the controller 18, then a smaller diameter hole 158 extends downward from the lowermost portion of the bore 156 to define an upward facing annular shoulder 160 in the lowermost end of the bore 156. The bore 158 is sized such that it is smaller than interface member 146, such that the upward facing annular shoulder 160 will act as a stop for supporting the interface member 146 (shown in FIG. 2). The controller member 18 has a flat, lower facing annular surface 162 into which two grooves 164 and 166 are formed. The grooves 164 and 166 are sized for receiving the protuberances 84 of the jaws 12 (shown in FIG. 2).

Figure 5:
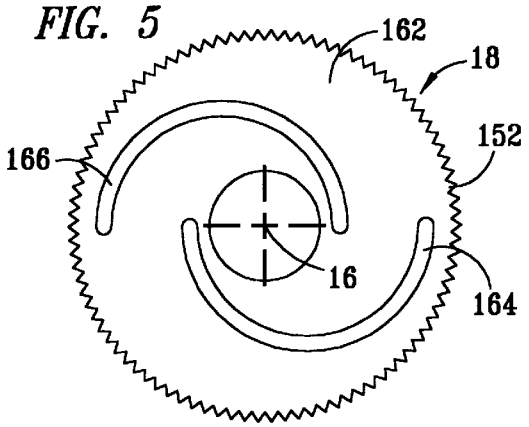
FIG. 5 illustrates a bottom view of the controller member of the size adjustable wrench socket.

Referring now to FIG. 5, there is illustrated a bottom view of the controller sleeve 18. The grooves 164 and 166 are shown to arcuately extend into the lower facing annular surface 162. The grooves 164 and 166 are substantially the same shape and configured such that the grooves 164 and 166 will guide a respective one of the protuberances 84 of the jaws 12 inward and outward within the jaw guide 14 (shown in FIG. 2). The grooves 164 and 166 are symmetrically disposed about the central axis 16, with the grooves 164 and 166 preferably being offset by 180.0 degrees about the central axis 16 in the two jaw embodiment of the size adjustable wrench socket 10. In other embodiments, more than two jaws may be used to provide a size adjustable wrench socket, and then, if controller grooves similar to controller grooves 164 and 166 are used in a controller member to engage protuberances from the jaws to selectively position the jaws, such grooves would be offset around a central axis of the wrench socket by an angular displacement which preferably will symmetrically space the jaws around a central axis of rotation. It should also be noted, that in other embodiments, protuberances may be utilized to extend from an alternative controller member for engaging within a recess, such as a groove, formed into the jaws being selectively spaced apart by selectively positioning the alternative controller member. The exterior lower periphery 152 of the controller sleeve 18 is knurled to provide a enhanced gripping engagement for a person utilizing the size adjustable wrench socket 10.

Referring again to FIG. 2, there is illustrated the jaw guide 14 having a cylindrical exterior service 76 and flat upper and lower, oppositely facing surfaces 168. Two rails 170 are formed in the jaw guide 14 by forming two symmetrical, vertically spaced apart rectangular grooves 171 which extend across the horizontal faces of respective ones of the horizontal surfaces 168, and two symmetrical, horizontally spaced apart grooves 173 which extend vertically through the jaw guide 14. A connecting portion 172 extends between the two rails 170, and is disposed between the two horizontally spaced apart grooves 173. The two rails 170 extend in parallel, defining an upwardly facing horizontal guide 25 surface 174 and upper vertically facing guide surfaces 176. The two upper vertical guide surfaces 176 are parallel, and are planar surfaces. The two rails 170 also each define a respective one of two lower vertically facing guide surfaces 178. The upward facing, horizontal guide surfaces 174 are disposed for providing a sliding interface in which the guide surfaces 174 slidably engaging the downwardly facing, upper shoulders 104 of the recess as 102 formed into the intermediate portions 100 of the jaws 12. The upper vertical guide surfaces 176 are planar surfaces, and configured for providing a sliding interfce in which the guide surfaces 176 slidably engaging the flats 96 of the upper portions 82 of the jaws 12. The lower vertically facing guide surfaces 178 are disposed for slidably engaging the exterior of the lower portions 120 of the jaws 12. Thus, the upper vertical guides 176 of the rails 170 slidably engage within the recesses 102 of the intermediate portion of the jaws 12, such that the jaws 12 are moveable radially inward and outward relative to the jaw guide 14. Additionally, the lower vertical guide surfaces 178 of the rails 170 of the jaw guide 14 slidably engage the lower portions 120 of the jaws 12 to provide further support for transferring torque from the drive socket 22 through the mandrel 20 into the jaw guide 14 to the jaws 12.

Figure 6:
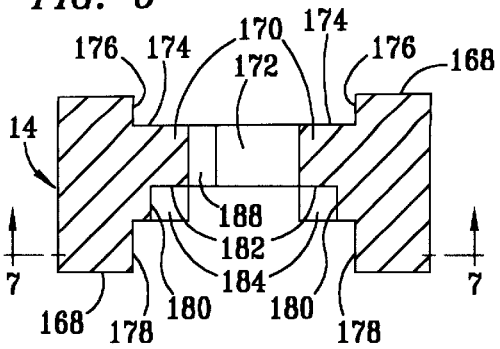
FIG. 6 illustrates a sectional view a jaw guide of the size adjustable wrench socket, taken along Section line 6—6 of FIG. 2.

Referring now to FIG. 6, there is illustrated a sectional view of the jaw guide 14, taken along section lines 6—6 of FIG. 2. The connecting portion 172 is shown extending between the rails 170. The horizontal and vertical guide surfaces 174 and 176 are defined by upward portions of the rails 170. The lower vertical guide surface 178 is disposed on the lower portions of the rails 170. The rails 170 further define a vertical alignment surface 180 for slidably engaging the latch member 62. The edges of the rack members 68 of the latch member 62 fit flush against the vertical alignment surfaces 180.

Figure 7:
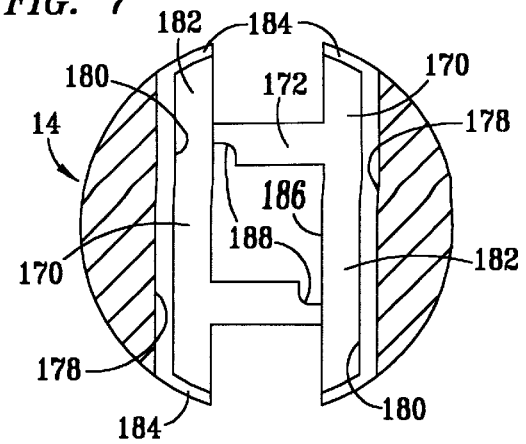
FIG. 7 illustrates a sectional view of the jaw guide, taken along section line 7—7 of FIG. 6.

Referring now to FIG. 7, there is illustrated a sectional view of the jaw guide 14, taken along section line 7—7 of FIG. 6. A horizontal alignment surface 182 is also provided for fitting flush against the latch member 62 when the latch member 62 is disposed in a released position, disengaged from the teeth 116 of the upwardly facing shoulders 106, which define the mating engagement surface of the jaws 12. Retaining tabs 184 extend as continuous end portions of the vertical alignment surfaces 180. The retaining tabs 184 slidably engage and fit flush with the rounded corners 74 of the rack members 68 of the latch member 62. The jaw guide 14 further includes a central hole 186 which has a square shape for receiving the lower section 38 of the lower section 32 of the mandrel 20. The shape of the central hole 186 matches the shape of the exterior of the mandrel 20 such that torque may be transferred from the mandrel 20 to the jaw guide 14. The notches 188 extend into two sides of the central hole 186 for slidably receiving the connecting members 54.

Figure 8:
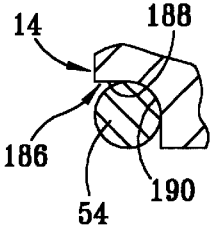
FIG. 8 illustrates an enlarged, detail view of a portion of the jaw guide of FIG. 7.

Referring now to FIG. 8, there is illustrated an enlarged, detail view of the notches 188 formed into the square shaped central hole 186 of the jaw guide 14. The notches 188 have rounded surfaces 190 which match the exterior profile of the connecting members 54 such that the connecting members 54 will slidably engage with rounded surfaces of the notches 188, without binding.

Figure 9:
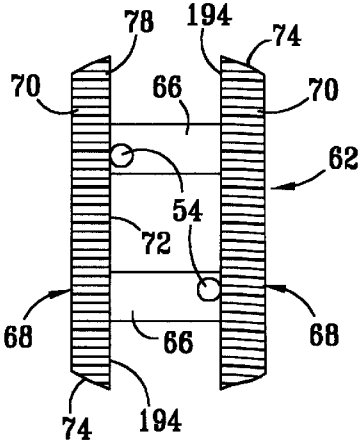
FIG. 9 illustrates a bottom view of a latch member of the size adjustable wrench socket.

Referring now to FIG. 9, there is illustrated a bottom view of the latch member 62. The two rack members 68 are shown as being spaced apart and extending in parallel. The two rack members are secured together by two spaced apart cross-members 66. The connecting members 54 are shown extending through the cross-members 66. The connecting members 54 are rigidly secured to the cross-members 66 such that upward movement of the connecting members 54 will cause the latch member 62 to move upwards, and downward movement of the connecting members 54 will cause the latch member 62 to move downwards. The slots 78 extend into opposite ends of the latch member 62, between the teeth 70, and define vertically extending guide surfaces 194 which engage the vertical surfaces of the rectangular-shaped recesses 102 in the intermediate portions 100 of the jaws 12 for transferring torque from the vertical alignment surfaces 180 of the jaw guide 14 to the jaws 12. Additionally, the upwardly extending tabs 114 of the ledge surfaces 112 of the intermediate portions 100 of the jaws 12 will also extend to engage the vertical guide surfaces 194 of the jaws guide 62. The tabs 114 are spaced apart from the upwardly extending main body portions 108 of the intermediate portions 100 of the jaws 12 for improving the transfer of torque from the jaw guide 14 to the jaws 12. The rounded corners 74 of the rack members 68 of the latch members 62 slidably engage and fit adjacent to the inward facing portions of the retaining tabs 184 which define respective portions of the vertical alignment surfaces 180.

Figure 11:
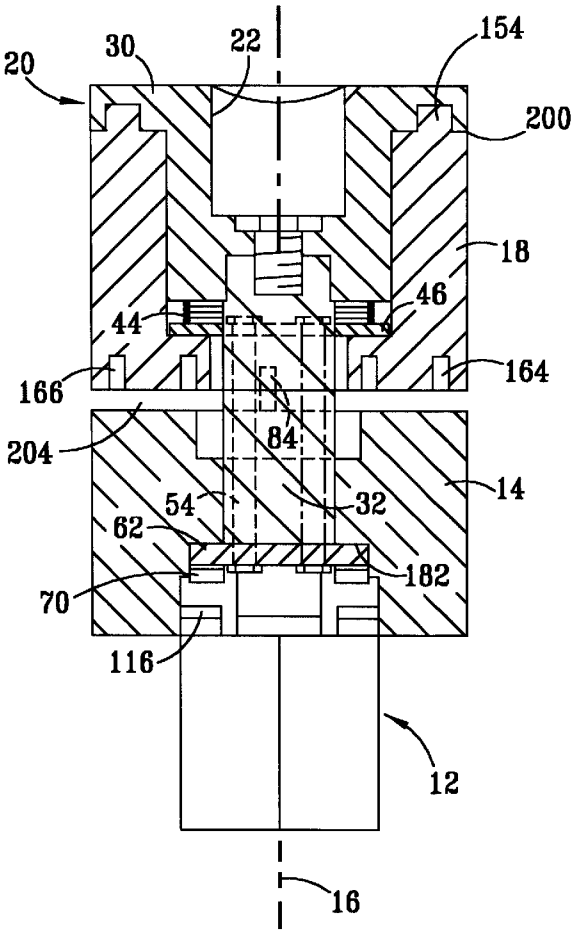
FIG. 11 illustrates a longitudinal section view of the size adjustable wrench socket as would be viewed in the same sectioning plane as FIG. 10, after the controller sleeve is lifted upward to move the latch member from a latched position to a released position to disengage the latch member from latching the jaws from moving relative to the jaw guide.
Figure 10:
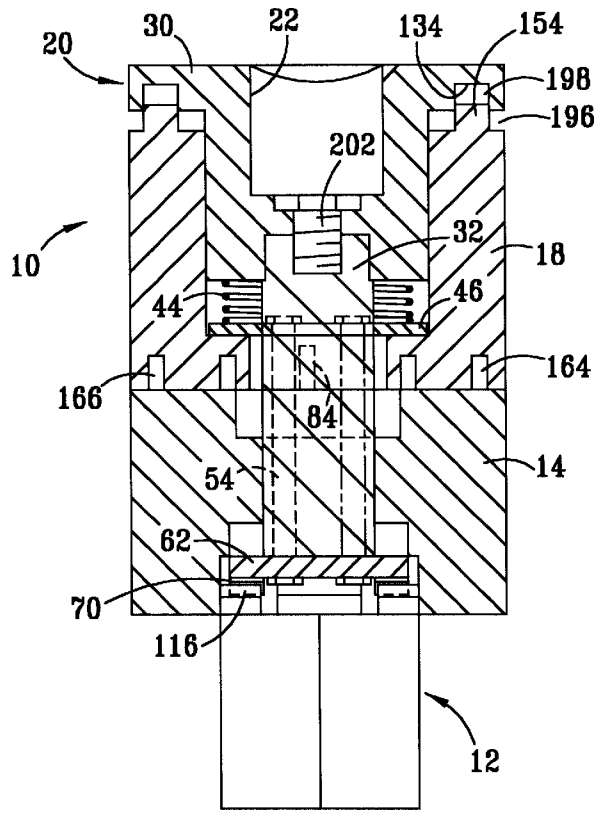
FIG. 10 illustrates a longitudinal section view of the size adjustable wrench socket in a latched position, taken along Section line 10—10 of FIG. 1.

Referring now to FIG. 10, there is illustrated a sectional view of the size adjustable wrench socket 10, taken along section line 10—10 of FIG. 1, with the jaws 12 latched into a fixed position relative to the jaw guide 14. The annular recess 134 and the annular tab 154 as shown in FIGS. 10 and 11 are offset toward an outward position relative to that shown for recess 134 and tab 154 in FIGS. 2, 3, and 4. The exterior peripheries of the upper drive socket portion 30 of the mandrel 20, the controller sleeve 18, and the jaw guide 14 are circular and have of the same diameter such that they fit flush when they are adjacent to one another. A gap 196 extends between the outward edge of the controller sleeve 18 and the outward edge of the portion 30 of the mandrel 20 when the controller sleeve 18 is disposed in a latched position, in which the jaws 12 are latched into a fixed position relative to the jaw guide 12. A gap 198 also extends between the upward face of the annular tab 154 of the controller sleeve 18 and the annular recess 134 of the upper portion 30 of the mandrel 20. The spring 44 is exerting a biasing force between the lower face of the upper portion 30 of the mandrel 20 and the upper planar surface of the interface member 46. The connecting members 54 (one shown in phantom and being projected from outward of the projection plane of FIGS. 10 and 11, and the other shown by hidden lines) extend through the interface member 46 and interior portions of the jaw guide 14 to couple the interface member 46 to the latch member 62. The latch member 62 is shown in the latching position, with downwardly extending teeth 70 of the latch member 62 engaging the upwardly extending teeth 116 of the jaws 12. The protuberances 84 (one shown as a hidden line) of the jaws 12 are extending into respective ones of the grooves 64 and 166.

Referring now to FIG. 11, there is illustrated a longitudinal section view of the size adjustable wrench socket 10, taken along the same sectioning plane as FIG. 10, with the jaws 12 released for moving relative to the jaw guide 14. The controller sleeve 18 has been moved upwardly with respect to the mandrel 20, from a latch position to a released position. Moving the controller sleeve 18 into the released position moves the latch member 62 into the released position shown, with the teeth 70 of the latch member 62 spaced apart and disengaged from the upwardly facing teeth 116 of the jaws 12. Moving the controller sleeve 18 upwards moves the interface member 46 upwards against the force of the bias spring 44. Upwards movement of the controller sleeve 18 into the released position also urges the annular tabs 154 into the annular recess 134, such that there is no longer a gap 196 and a gap 198 (see FIG. 10) between the upper portion 30 of the mandrel and the upper portion of the controller sleeve 18. A gap 204 now extends between the jaw guide 14 and the controller sleeve 18. This moves the connecting members 54 and the latch 10 members 62 upward and into the released position, such that the teeth 70 are no longer engaged with teeth 116 of the jaws 12. The protuberances 84, which extend upward from the jaws 12 into respective ones of the grooves 164 and 166, are preferably of a length such that they remain engaged within respective ones of the grooves 164 and 166 when the controller sleeve 18 is moved upward and into released position depicted in FIG. 11. The jaws 12 are now free to move radially inward and radially outward with respect to the jaw guide 14, in response to corresponding rotation of the controller sleeve 18 around the central axis 16.

In operation, the controller sleeve 18 will be lined from the downward position shown in FIG. 10 to the upward position shown in FIG. 11, such that the latch member 62 is moved to a released position in which the teeth 70 the latch member 62 are no longer engaged with the teeth 116 of the jaws 12. The controller sleeve 18 may then be rotated in selected directions to either move the jaws 12 radially inward or radially outward such that the jaws 12 are spaced apart for engaging a predetermined size of threaded fasteners. The teeth 70 of the latch member 62 and the teeth 116 of the jaws 12 are correspondingly sized such that they provide indexing for positioning the jaws 12 in fixed positions radially inward and radially outward relative to the central axis 16 according to standard sizes of threaded fastener heads. Once the jaws 12 are spaced apart to accommodate a selectable predetermined size of a threaded fastener, the controller sleeve 18 is released and the spring 44 will urge the controller sleeve 18 downward relative to the mandrel 20. This releases the connecting members 54 from pulling upward on the latch member 62, and the bias spring 44 pushing against the interface member 46 will urge the latch member 62 downward and into the latched position, in which the teeth 70 of the latch member 62 are engaged with teeth 116 of the jaws 12. Then, a drive member may be engaged within the drive socket 22 and torque may be transferred from the driver 26, through the mandrel 20 and to the jaw guide 14, the latch member 62, the jaws 12 and a threaded fastener 28. The operation is then repeated for adapting the size adjustable wrench socket 10 for use on threaded fasteners of different sizes.

The present invention provides several advantages over prior art size adjustable wrench sockets. The jaws are easily spaced apart by lifting and then rotating a coupling sleeve until the jaws are spaced apart by a distance, which is predetermined according to various indexed settings that correspond to standard sizes of threaded fasteners. The latch member directly engages an intermediate portion of the moveable jaws such that the moveable jaws are more rigidly secured to the jaw guide and a drive mandrel transferring torque from a driver to the head of a threaded fastener. A plurality of guide surfaces transfer torque from the jaw guide and the latch member directly to the jaws which engage the drive surfaces of threaded fastener.

Although the preferred embodiment has been described in detail, it should be understood that various changes, substitutions and alterations can be made therein without departing from the spirit and scope of the invention as defined by the appended claims.

What is claimed is:

1. In a size adjustable wrench socket of the type having a plurality of jaws which include upper, intermediate and lower portions, a jaw guide configured for mating with said intermediate portions of said jaws such that said jaws are movable radially inward and outward relative to said jaw guide for determining a distance by which said lower portions of said jaws are spaced apart for engaging a threaded fastener for transferring torque therebetween, a controller sleeve having a lower portion for engaging said upper portions of said jaws such that rotation of said controller sleeve in a first direction urges said jaws radially inward relative to said jaw guide and rotation of said controller sleeve in a second direction urges said jaws radially outward relative to said jaw guide, and a mandrel which is coupled to said jaw guide for transferring torque therebetween, said mandrel having one of a socket and a pin connection for coupling to a drive member having the other of said socket and said pin connection to rotationally couple said jaw guide to the drive member for transferring torque therebetween, the improvement comprising:

a latch member which is moveable relative to said jaws, and slidably secured to said mandrel said latch member having a latch surface for disposing in a latched position, in which said latch surface engages a mating surface of said jaws to latch said jaws into a fixed position relative to said jaw guide, and said latch member being moveable relative to said mandrel, said jaws and said mating surface of said jaws from said latched position to a released position, in which said latch surface is spaced apart from said mating surface such that said jaws are moveable relative to said jaw guide.

2. The size adjustable wrench socket according to claim 1, wherein said mating surface of said jaws and said latch surface of said latch member, when disposed in said latched position, are disposed beneath guide surfaces of said jaw guide and said intermediate portions of said jaws, which are slidably engaged.

3. The size adjustable wrench socket according to claim 2, wherein each of said jaws includes at least one of a mating rib and a mating groove which at least in part defines said mating surface of said jaws, and said latch member includes at least one of a latch groove and a latch rib for engaging said at least one of said mating rib and said mating groove of said jaws to latch said jaws into said fixed position relative to said jaw guides.

4. The size adjustable wrench socket according to claim 3, wherein:

said mating surface of said jaws faces upwards and said latch surface of said latch member faces downward, opposite said mating surface;

said controller sleeve slidably engages said mandrel for moving upwards and downward relative to said mandrel; and said latch member is secured to said controller sleeve for moving upwards relative to said jaws and into said released position when said controller sleeve is moved upward relative to said mandrel, and for moving downward into said latched position when said controller sleeve is moved downward relative to said jaws.

5. The size adjustable wrench socket according to claim 4, wherein said jaws include tabs which upwardly extend for slidably engaging said jaw guide, spaced apart from a sliding engagement located between said intermediate portions of said jaws and said guide surfaces of said jaw guide.

6. The size adjustable wrench socket according to claim 4, wherein:

said jaw guide includes a plurality of linearly extending rails which define guide surfaces therebetween, and said jaws each include recesses formed to laterally extend into opposite sides of said intermediate portions thereof for slidably receiving said rails; and said upper portions of said jaws define upwardly extending protuberances, and said controller sleeve includes a plurality of downwardly facing grooves which are configured to arcuately extend for receiving said upwardly extending protuberances such that rotation of said controller sleeve in said first and second directions urges said jaws radially inward and radially outward relative to said jaw guide, respectively.

7. The size adjustable wrench socket according to claim 1, wherein each of said jaws includes at least one of a mating rib and a mating groove which at least in part defines said mating surface of said jaws, and said latch member includes at least one of a latch groove and a latch rib for engaging said at least one of said mating rib and said mating groove of said jaws to latch said jaws into said fixed position relative to said jaw guides.

8. The size adjustable wrench socket according to claim 1, wherein:

said mating surface of said jaws faces upwards and said latch surface of said latch member faces downward, opposite said mating surface;

said controller sleeve slidable engages said mandrel for moving upwards and downward relative to said mandrel; and said latch member is secured to said controller sleeve for moving upwards relative to said jaws and into said released position when said controller sleeve is moved upward relative to said mandrel, and for moving downward into said latched position when said controller sleeve is moved downward relative to said jaws.

9. A size adjustable wrench socket for placing between a drive member and threaded fasteners of various sizes, and adjusting to engage the threaded fasteners for transferring torque between the drive member and the threaded fasteners, the size adjustable wrench socket comprising:

a plurality of jaws which include upper, intermediate and lower portions, a jaw guide configured for mating with said intermediate portions of said jaws such that said jaws are movable radially inward and outward relative to said jaw guide for determining a distance by which said lower portions of said jaws are spaced apart for engaging the threaded fasteners of the various sizes for transferring torque therebetween;

a controller sleeve having a lower portion for engaging said upper portions of said jaws such that rotation of said controller sleeve in a first direction urges said jaws radially inward relative to said jaw guide and rotation of said controller sleeve in a second direction urges said jaws radially outward relative to said jaw guide, and a mandrel coupled to said jaw guide for transferring torque therebetween, said mandrel having one of a socket and a pin connection for coupling to the drive member, the drive member having one of a drive socket and a drive pin connection of the type for mating with said one of said socket and said pin connection to rotationally couple said jaw guide to the drive member for transferring torque therebetween;

a latch member which is moveable relative to said jaws, and slidably secured to said mandrel said latch member having a latch surface for disposing in a latched position, in which said latch surface engages a mating surface of said jaws to latch said jaws into a fixed position relative to said jaw guide, said latch member being moveable relative to said mandrel, said mating surface of said jaws from said latched position to a released position, in which said latch surface is spaced apart from said mating surface such that said jaws are moveable relative to said jaw guide; and wherein said mating surface of said jaws is defined by recesses formed into said intermediate portions of said jaws wherein said recesses define a shoulder.

10. The size adjustable wrench socket according to claim 9, wherein said shoulder of said intermediate portions of said jaws includes tabs which extend from said shoulders for slidably engaging said jaw guide.

11. The size adjustable wrench socket according to claim 9, wherein said mating surface of said jaws faces upwards and has at least one of a first rib and a first groove, said latch surface of said latch member faces downward, opposite said mating surface, and has at least one of a second groove and a second rib for engaging said one of said first rib and first groove to interlock said jaws to said latch member such that said jaws are fastened into a fixed position relative to said jaw guide.

12. The size adjustable wrench socket according to claim 9, wherein:

said controller sleeve slidably engages said mandrel for moving upwards and downward relative to said mandrel; and said latch member is secured to said controller sleeve for moving upwards relative to said jaws and into said released position when said controller sleeve is moved upward relative to said mandrel, and for moving downward into said latched position when said controller sleeve is moved downward relative to said jaws.

13. The size adjustable wrench socket according to claim 9, further comprising:

said upper portions of said jaws defining upwardly extending protuberances;

said controller sleeve including a plurality of downwardly facing grooves which are configured to arcuately extend for receiving said upwardly extending protuberances such that rotation of said controller sleeve in said first and second directions urges said jaws radially inward and radially outward relative to said jaw guide, respectively;

said mating surface of said jaws being disposed to face upwards and having at least one of a rib and a groove;

said latch surface of said latch member being disposed to face downward, opposite of said mating surface, and having the other of said rib and said groove for engaging said one of said rib and said groove to interlock said jaws to said latch member such that said jaws are fastened into a fixed position relative to said jaw guide;

said controller sleeve being slidably mounted to said mandrel for moving upwards and downwards relative to said mandrel; and wherein said latch member is secured to said controller sleeve for moving upwards relative to said jaws and into said released position when said controller sleeve is moved upward relative to said mandrel, and for moving downwards into said latched position when said controller sleeve is moved downwards relative to said jaws.

14. A size adjustable wrench socket for placing between a drive member and threaded fasteners of various sizes, and adjusting to engaging the threaded fasteners for applying torque from the drive member to the threaded fasteners, the size adjustable wrench socket comprising:

a plurality of jaws which include upper, intermediate and lower portions, said intermediate portions of said jaws having oppositely facing recesses which laterally extend into opposite sides of said intermediate portions;

said jaws having an upward facing surface and a first plurality of teeth formed into said upward facing surface, said first plurality of teeth having roots and crests which extend substantially perpendicular to a linear direction in which said jaws are adjusted relative to one another for engaging the threaded fasteners of various sizes for transferring torque therebetween;

each of said jaws further including a protuberance which upwardly extends from respective ones of said upper portions of said jaws;

a jaw guide having rails which are spaced apart for slidably engaging within said recesses extending into said intermediate portions of said jaws, said rails extending in said linear direction along which said jaws are adjustable for determining a distance by which said lower portions of said jaws are spaced apart for engaging the threaded fasteners of the various sizes for transferring torque therebetween;

a mandrel having a lower and an upward end, said lower end being mounted to said jaw guide for transferring torque therebetween, and said upper end including one of a socket and a pin connection for coupling to the drive member, the drive member having a drive socket or a drive pin connection of the type for mating with said socket and said pin connection for transferring torque therebetween;

a controller sleeve having a lower surface into which are formed arcuately extending grooves for engaging said upwardly extending protuberances of said jaws, such that rotation of said controller sleeve in a first direction urges said jaws radially inward relative to said jaw guide and rotation of said controller sleeve in a second direction urges said jaws radially outward relative to said jaw guide; and a latch member having a downward facing surface and a second plurality of teeth formed into said downward facing surface for engaging said first plurality teeth formed into said upward facing surface of said jaws when said latch member is disposed in a latched position to latch said jaws from moving relative to said jaw guide, said latch member being upwardly movable relative to said jaws from a latched position to a released position such that said jaws are moveable relative to said jaw guide.

15. The size adjustable wrench socket according to claim 14, wherein said upward facing surfaces of said jaws are defined by shoulders of said recesses.

16. The size adjustable wrench socket according to claim 15, wherein said shoulders of said recesses in said intermediate portions of said jaws include tabs which extend upward from said shoulders for slidably engaging said jaw guide, spaced apart from an adjacent sliding interface between said recesses and said jaw guide.

17. The size adjustable wrench socket according to claim 14, wherein:

said controller sleeve slidable engages said mandrel for moving upwards and downwards relative to said mandrel; and said latch member is secured to said controller sleeve for moving upwards relative to said jaws and into said released position when said controller sleeve is moved upward relative to said mandrel, and for moving downwards into said latched position when said controller sleeve is moved downwards relative to said jaws.

18. The size adjustable wrench socket according to claim 14, wherein the lower portions of each of said jaws have two adjoining engagement surfaces for engaging against adjoining surfaces of said threaded fastener.

19. The size adjustable wrench socket according to claim 14, further comprising:

said controller sleeve having an interior bore which defines an upward facing annular shoulder, and said controller sleeve mounted to said mandrel for slidably moving upwards and downwards relative to said mandrel;

an interface member disposed within said interior bore and above said upward facing annular shoulder of said controller sleeve, and said interface member slidably extending around said mandrel;

a bias member having an upper end engaging said mandrel and a lower end engaging said interface member for urging said interface member into a downward position relative to said mandrel, such that said interface member engages said upward facing annular shoulder of said controller sleeve and urges said controller sleeve downward relative to said mandrel;

a connecting member having first and second ends, said first end being secured to said interface member and said second end being secured to said latch member, such that said bias spring urges said latch member downward against said upward facing surface of said jaws and into said latched position, interlocking said first and second plurality of teeth;

wherein said controller sleeve is movable upwards against said bias spring, moving said interface and connecting member upward into an upper position, to move said latch member upwards to said released position; and wherein said upwardly extending protuberances of said jaw guides have a length for remaining engaged within said arcuate grooves of said controller sleeve when said controller sleeve is moved to said upper position, in which said latch member is disposed in said released position.

20. The size adjustable wrench socket according to claim 19, wherein said latch member has an exterior profile which is H-shaped to define two slots for receiving said jaws, with said legs of said H-shaped exterior profile fitting within said recesses of said jaws.

* * * * *